US005462260A

United States Patent [19]

Lonardi et al.

[11] Patent Number: 5,462,260

[45] Date of Patent: Oct. 31, 1995

[54] DEVICE FOR INSERTING A LANCE INTO A PRESSURIZED CONTAINER, IN PARTICULAR A BLAST FURNACE

[75] Inventors: Emile Lonardi, Bascharage; Radomir Andonov, Mamer; Giovanni Cimenti, Fentange, all of Luxembourg

[73] Assignee: Paul Wurth S.A., Luxembourg

[21] Appl. No.: 250,752

[22] Filed: May 26, 1994

[30] Foreign Application Priority Data

May 27, 1993 [LU] Luxembourg ..... 88279

[51] Int. Cl.[6] ..... C21B 7/24

[52] U.S. Cl. ..... 266/226; 266/269

[58] Field of Search ..... 266/80, 99, 226, 266/269; 73/863.11

[56] References Cited

U.S. PATENT DOCUMENTS

| | | | |
|---|---|---|---|
| 3,632,100 | 1/1972 | Schneider | 266/226 |
| 3,643,508 | 2/1972 | Schneider | 73/344 |
| 4,361,315 | 11/1982 | Kajihara et al. | 266/226 |
| 4,471,664 | 9/1984 | Mailliet et al. | 73/863.11 |
| 4,747,581 | 5/1988 | Mailliet et al. | 266/226 |
| 4,836,509 | 6/1989 | Daverio et al. | 266/226 |

*Primary Examiner*—Scott Kastler

*Attorney, Agent, or Firm*—Fishman, Dionne & Cantor

[57] ABSTRACT

A device is presented for inserting, from a support structure a lance axially through a side opening in a pressurized container, in particular a blast furnace. This device comprises a support bench on which a support carriage can slide. A front elastic support for the lance is mounted so as to follow the level variations of the side opening. When the lance is inserted into the container, the front elastic support yields and the lance bears on an internal support.

9 Claims, 4 Drawing Sheets

DEVICE FOR INSERTING A LANCE INTO A PRESSURIZED CONTAINER, IN PARTICULAR A BLAST FURNACE

BACKGROUND OF THE INVENTION

This invention relates generally to a device for inserting a lance through a side opening in a pressurized container, in particular a blast furnace. More particularly, this invention relates to a device for inserting, from a support structure, a lance axially through a side opening in a pressurized container, in particular a blast furnace, which is able to compensate for level variations between the side opening in the pressurized container and the support structure.

A device of this type is known from U.S. Pat. No. 3,643,508. It is used for inserting a measuring lance, for measuring the temperature and taking samples of gases, into a blast furnace and comprises a support bench and three supports for the lance. A support carriage can slide along the support bench and the rear end of the lance is articulated therein. A front bearing for the lance is arranged in proximity to a sealing and closing member. An inner support for the lance, is arranged behind the sealing and closing member on the inner side of the blast furnace.

It is to be recalled that for a modern blast furnace, such a measuring lance may have a length of 8 meters or more. The object of the internal support is to reduce the overhanging length of the lance when the lance is introduced through the sealing and closing member inside the blast furnace. In other words, the purpose of this internal support is to reduce the mechanical stresses to which the probe is exposed when overhanging this internal support. Such an internal support for a blast furnace probe is described in detail in U.S. Pat. No. 4,471,664.

In the device known from U.S. Pat. No. 3,643,508, the support bench for the lance is supported, on the blast furnace side, on the support structure by a height-adjustable support. The front support for the lance is integral with the support bench. When the side opening undergoes a level variation with respect to the support structure, which may be due to a thermally induced expansion of the blast furnace, the height-adjustable support of the support bench should be adjusted in order to compensate for this level variation. For a person skilled in the art, it is clear that this adjustment constitutes a time consuming and costly task which it is desirable to eliminate. Furthermore, after adjustment of the level of the front end of the supporting bench, the three support points of the lance are no longer aligned. This indicates that the lance supported by the support carriage and the front support no longer bears on the internal support. This results in the lance undergoing mechanical stresses which are much greater than intended.

SUMMARY OF THE INVENTION

The above discussed and other problems and deficiencies of the prior art are overcome or alleviated by the device for inserting a lance into a pressurized container, in particular, a blast furnace of the present invention. In accordance with the present invention, a device for inserting, from a support structure, a lance axially through a side opening in a pressurized container, in particular a blast furnace, comprises:

- a support bench for the lance bearing with its rear end on the support structure and extending towards the side opening;

- a support carriage for the lance, which can slide along the support bench and in which the rear end of the lance is articulated;
- a sealing member and a closure member which are mounted on the pressurized container at the level of the side opening, the sealing member being designed to interact with the lance in order to ensure leaktightness around the lance when it is inserted therein, and the closure member being de:signed to close the side opening when the lance is withdrawn;
- a front bearing for the lance, which is arranged in proximity to the sealing member; and
- an inner support for the lance, which is arranged on the inner side of the pressurized container;
- wherein the front support for the lance is an elastic support, that is mounted so as to follow the level variations of the side opening.

As the lance is inserted axially into the container, the elastic support is gradually pressed down under the weight of the lance until the lance bears on the internal support. The main advantage of the device in accordance with the present invention is to guarantee the effectiveness of the internal support, even when the side opening undergoes a level variation which causes initial misalignment of the three support points of the lance. This results in a substantial reduction of the maximum mechanical stresses (e.g., bending moment, transverse force) to which the lance is exposed.

Another advantage of this device is that the support bench no longer requires level adjustment, in order to account for a level variation of the side opening with respect to the support structure. In fact, insertion of the lance into the sealing member no longer causes a problem of centering the lance, because the lance is supported, in proximity to this sealing member, by the front support which follows the level variations of the side opening. The front end of the lance will therefore remain perfectly centered with respect to the sealing member if the side opening undergoes level variations with respect to the support structure.

In a preferred embodiment of the present invention, the support bench is supported using a support articulated on a wall of the pressurized container, in proximity to the side opening. In this manner, the front end of the support bench automatically follows the deformations of this wall and the level variations of the side opening which result therefrom. One advantage of a support bench whose front end undergoes the level variations of the side opening resides in smaller axial misalignment of the lance in the sealing member.

The front support is then advantageously supported by the support bench in proximity to the articulated support. It is, however, also possible to provide a front support which is directly supported by a wall of the pressurized container or which is integral with the sealing member or with the closure member.

It will be noted that the front support advantageously comprises a prestressed spring in order to give it its elastic support feature. The prestress of the spring avoids, amongst other things, deformation of the spring before the front end of the lance has passed beyond the internal support. A spring may then be chosen which rapidly yields when the load which it is to support exceeds the prestress load, that is to say, as soon as the front end of the lance has passed beyond the internal support.

In an advantageous embodiment, the sealing member comprises a casing and several rings provided with through openings for the lance. The casing is axially divided into separate chambers, in which the rings are mounted so that they can be moved perpendicularly to the central axis of the sealing member. The rings may then adapt to an oblique position of the lance in the sealing member, or, in other words, they can be centered freely on the lance, when the lance is inserted through the sealing member. It will be noted that the chambers of the casing define, in cooperation with the mobile rings, a type of labyrinth seal.

The rings are preferably fitted with packings or sealing gaskets with which they bear on the lance. At least one of these sealing gaskets is preferably an inflatable seal which adapts to the variations in the clearance between the lance and the respective ring.

The above-discussed features and advantages of the present invention will be appreciated and understood by those or ordinary skill in the art from the following detailed discussion and drawings.

BRIEF DESCRIPTION OF THE DRAWINGS

Referring now to the drawings, wherein like elements are numbered alike in the several Figures.

DESCRIPTION OF THE PREFERRED EMBODIMENT

Figure 1:
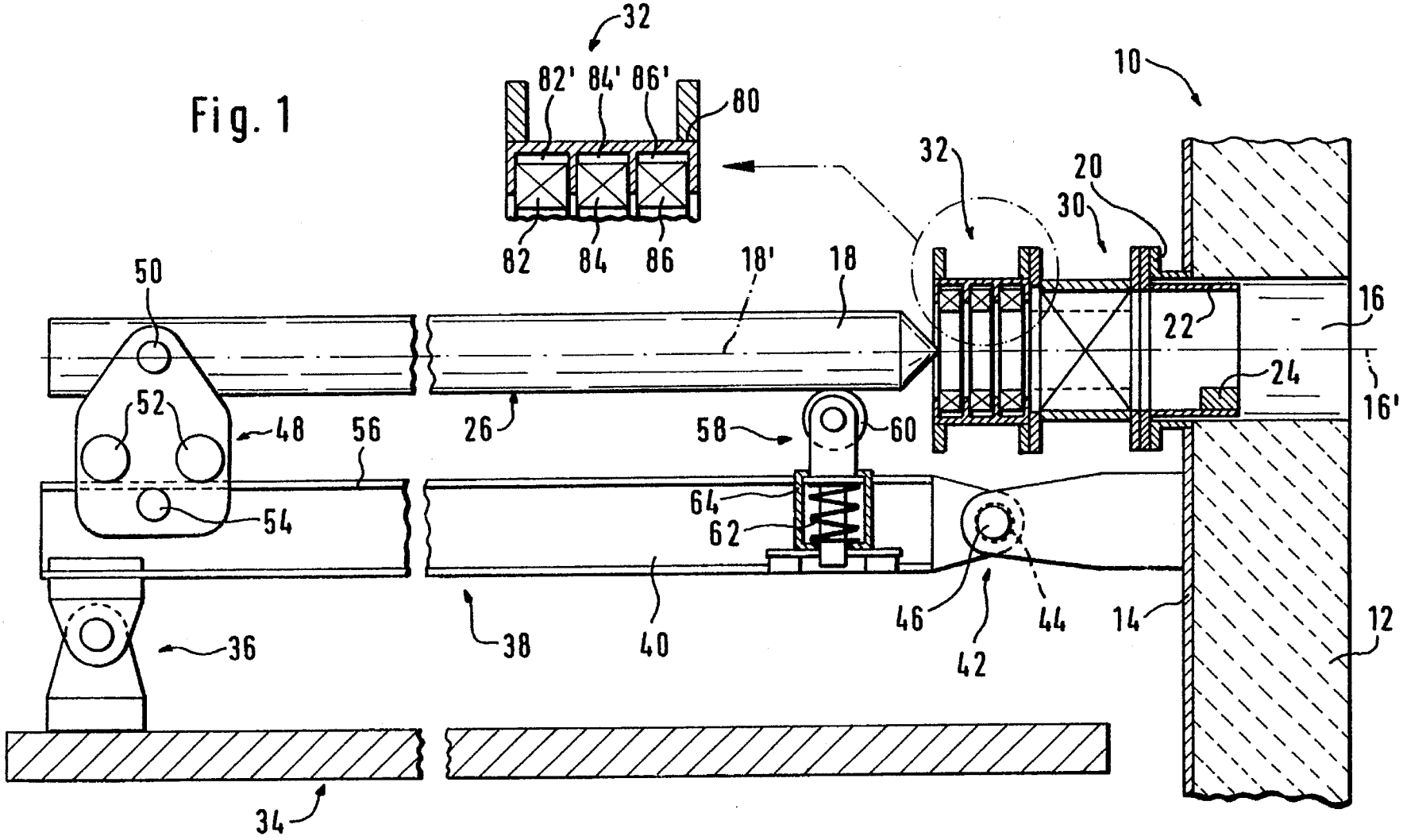
FIG. 1 is a front elevation view, partially in cross section, of the device for inserting a lance into a pressurized container, in particular a blast furnace in accordance with the present invention.

FIG. 1 diagrammatically shows a front view, partially in section, of a device in accordance with the present invention. The reference 10 labels, in a general manner, a side wall of a pressurized container. This is, for example, the wall of a shaft furnace, more specifically a blast furnace, which undergoes thermal deformations. This side wall comprises an inner refractory lining 12 and an outer metal shielding 14. It is provided with a side opening 16 for axial insertion of a lance 18.

In order to give a concrete example, it may be assumed that this lance constitutes, for example, a probe for measuring the temperature and/or taking samples of gases from a blast furnace. Such a probe may, on a modern blast furnace, have a length of 8 meters or more, with a height of its cross-section of the order of 100 mm in the case of a probe for taking measurements above the charge, or of the order of 250 mm in the case of a lance which is inserted using a powerful axial force into the charge. It is clear that, in both cases, such a probe perfectly corresponds to the definition of a lance. It is, however, also clear for a person skilled in the art that the term lance is not limited to such probes for blast furnaces.

Figure 4:
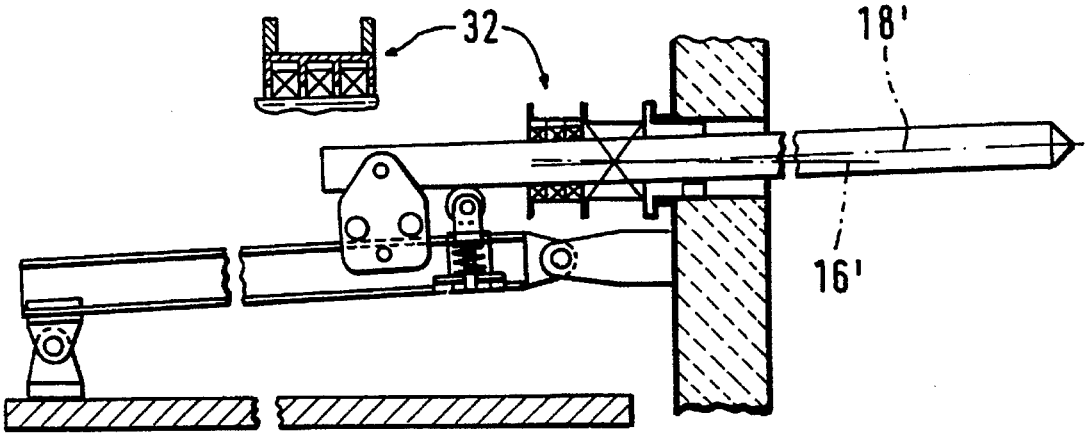

It is seen in FIG. 1 that the opening 16 is surrounded by a flange 20, which is integral with the shielding 14 and which therefore follows the deformations thereof. An internal support member 22 for the lance 18 is fastened onto this flange 20. This member 22 extends axially towards the inside of the container, represented by its side wall 10, and defines, at the level of the refractory lining 12, an internal support 24 for the lance. As is seen in FIG. 4, this is a support block on which the lance 18 can bear with its lower periphery 26. It is self-evident that this support block 24 is advantageously designed so as to match the lower periphery 26 of the lance 18. On a blast furnace or shaft furnace, the support member 22 is advantageously connected to a circuit for circulating a cooling liquid and fitted with a refractory lining. If the ambient conditions inside the pressurized container so allow, the internal support may also be fitted with one or more rollers on which the lance 18 bears with its lower periphery 26.

The object of this internal support is to reduce, as much as possible, the overhanging length of the lance 18 inside the container. It will consequently be advanced as far as possible into the pressurized container. It is, however, self-evident that, on a blast furnace, or a shaft furnace, the conditions prevailing inside this furnace allow the internal support 24 to be advanced scarcely beyond the thickness of the refractory lining 12.

It will also be noted that, instead of forming part of a support member 22 fixed to a flange 20 integral with the shielding 14, the internal support 24 might alternatively be supported in any manner by the pressurized container. It is, however, recommended to choose a means of supporting the internal support 24 which guarantees that the distance between the internal support 24 and a central axis 16', which is defined by the flange 20, is substantially constant when the composite side wall 10 undergoes deformations perpendicular to this central axis 16'. In the example represented in FIG. 1, this condition is satisfied by the fact that the internal support 24 is supported, overhanging, by the support member fastened onto the flange 20 which defines the central axis 16'.

The flange 20 supports, on the outer side of the wall 10, a closure member 30 and a sealing member 32. The object of the closure member 30 is to make it possible to close the side opening 16 in a leaktight manner when the lance 18 is withdrawn from the sealing member 32. It is most often a closure member developed especially for this function. The object of the sealing member 32 is to ensure leaktightness around the lance, either when it is moved axially therethrough or when it is in the measuring position inside the pressurized container. Additional features and advantages of this sealing member 32 will be described hereinbelow.

The reference 34 refers globally to a support structure which does not, or does not entirely, follow the vertical deformations of the wall 10. It is, for example, an independent platform surrounding the pressurized container at the level of the opening 16. This support structure is fitted with an articulated support 36 for a support bench 38 supporting the lance 18. Formed by one or more girders 40, the support bench 38 extends axially towards the side opening 16. While the articulated support 36, which is integral with the support structure 34, constitutes the rear support of the support bench 38, its from support preferably consists of an articulated support 42 which is integral with the wall 10. One of the two articulated supports 36, 42 of the support bench 38 is preferably designed so as to allow a slight horizontal translation of the support bench 38 with respect to this support. In the device represented in FIG. 1, this horizontal translation is, for example, made possible, at the level of the front support 42, by a housing in the form of oblong holes 44 for the pivot axle 46. Instead of incorporating a possibility of axial translation in one of the two articulated supports 36 and 42, it might, however, also be possible to provide a possibility of sliding at the level of the rear support 36 of the support bench 38 with respect to the support structure 34. What is actually important is to take into account the fact that the distance between the two supports 36 and 42 of the support bench 38 varies not only when the wall 10 of the pressurized container undergoes horizontal deformations, but also when it undergoes vertical deformations.

The lance 18 is mounted on the support bench 38 using a support carriage 48. Support carriage 48 constitutes an articulated support for the rear end of the lance 18 which can be moved axially with the lance 18. It will be noted that this support carriage 48 is designed so as to allow a slight pivoting of the lance 18 and at the same time to take up the bearing reaction perpendicularly to the support bench 38, whatever the orientation of this reaction. For this purpose, it comprises, for example, upper 52 and lower 54 rolling runners, or equivalent means, situated on either side of a rolling track 56 integral with the support bench 38.

At the front of the support bench 38, in proximity to the sealing member 32, the lance 18 is supported by a front support 58. This is a support on which the lance 18, in axial translation on the support bench 38, can be guided with its lower periphery 26, for example a support fitted with one or more rollers 60 or equivalent means. The first object of this front support 58 is to facilitate insertion of the front end of the lance 18 into the sealing member 32. In FIG. 1, this front support 58 is itself supported on the support bench 38, in immediate proximity to the articulation 42. It may be assumed that the distance of the front support 58 with respect to the central axis 16' of the sealing member remains substantially constant, even if the wall 10 deforms vertically with respect to the support structure 34. In fact, considering the large distance between the articulated supports 36 and 42, a point situated in proximity to one of the two ends of the support bench 38 undergoes substantially the same vertical displacement as the articulated support 36, 42 of this end and, considering the small distance between the central axis 16' and the articulated support 42, the articulated support 42 undergoes substantially the same level variation as the central axis 16'.

It is important to note that this front support 58 is an elastic support. In other words, the front support 58 may undergo a reversible deformation as a function of the force which is applied to it. In FIG. 1, it is seen that such an elastic support may, for example, comprise one or more springs 62. These springs 62 are advantageously prestressed in a casing 64, so that the front support 58 behaves as a rigid bearing until an upper limit value of the force applied is reached, then deforms rapidly as a function of the applied force. The prestress may, for example, be calculated so that the spring 62 starts to deform only from the moment when the front end of the lance 18 passes beyond the internal support 24. For a person skilled in the art, it is clear that the front elastic support 58 may be produced with other means. Thus, it is, for example, possible to replace the coil spring with a leaf spring, with a disc spring, with an elastomer block, with a hydraulic jack or by any other equivalent means capable of producing an elastic support characteristic.

It will be noted that, instead of being mounted on the support bench 38, the front support 58 may also be mounted on an independent support which is integral with the wall 10, or even be directly fixed to the sealing member 32. In the case in which the front support 58 is not supported on the support bench 38, the support bench 38 might naturally be supported entirely by the support structure 34, because its front end no longer need necessarily follow the vertical deformations of the wall 10. If it is desired, on the other hand, to make the front end of the support bench 38 follow the vertical deformations of the wall 10, without, for that matter, articulating it on the wall 10, it is also possible to provide, on the support structure 34, a front support of the support bench 38 which is adjustable in height. Such a system for adjusting the level of the support bench 38 might, for example, comprise one or more jacks, supported on the support structure 34 and themselves supporting the front end of the support bench 38. These jacks will then be equipped with an adjusting circuit, in which the setting parameter is the level difference between a point on the front end of the support bench and a point on the wall 10.

Figure 2:
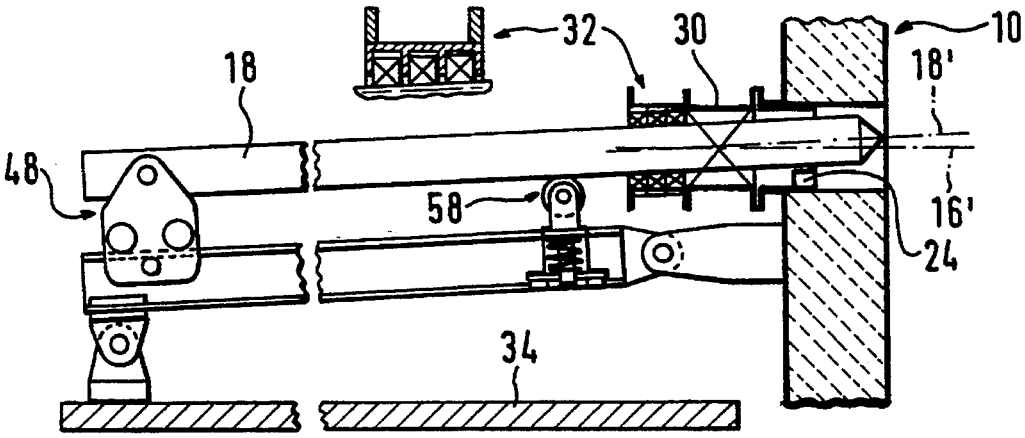
FIGS. 2, 3 and 4 are front elevation views of the device of FIG. 1, similar to FIG. 1 for various lengths of insertion of the lance into the pressurized container.
Figure 3:
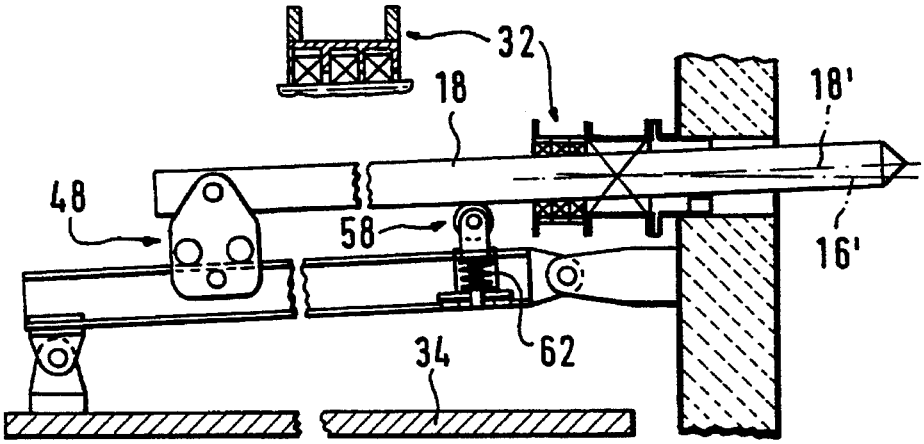

FIGS. 2 to 4 will be used to describe the operation of the device in FIG. 1. It should first be noted that FIG. 1 represents a situation in which the axis 18' of the lance 18 is perfectly aligned with the central axis 16' of the sealing member 32. This situation may, for example, correspond to the case of a blast furnace during shut-down, when the wall 10 is already substantially cooled. In FIGS. 2, 3 and 4, the wall 10 has undergone deformations which have caused a rise in the level of the side opening 16 with respect to the support structure 34. This situation may, for example, correspond to the case of a blast furnace which has undergone axial enlargement, due to the thermal expansion of the wall 10 when it is heated. By virtue of the front support 58, mounted so as to follow the level variations of the side opening 16, the front end of the lance 18 has itself also followed the rise in the level of the side opening 16. In this manner, it was able to be introduced without problems through the sealing member 32 and the closure member 30 in order to occupy the position shown in FIG. 2.

In view of the fact that the rear end of the lance 18, which is articulated in the support carriage 48 supported on the support bench 38, has not followed the same level variation as the side opening 16, the axis 18' of the lance 18 is no longer held aligned with the central axis 16' of the sealing member 32. A detrimental consequence of this inclination of the lance 18 with respect to the central axis 16' is that the lance 18 is no longer supported by the internal support 24. The overhanging length of the lance is therefore no longer determined by the internal support 24 but by the front support 58.

As the lance 18 is inserted axially into the pressurized container, the load which the front support 58 must support increases. Since this front support 58 constitutes a prestressed elastic support, a moment is reached where the load which it must support exceeds the prestressed force of the spring 62. From this moment on, the spring 62 starts to deform. In other words, the support 58 starts to be pressed down under the load which it has to support. This pressing down of the support 58 leads to pivoting of the rear end of the lance 18 about its articulation 50 in the support carriage 48 (compare FIGS. 2 and 3). For a length of insertion of the lance 18 which is predeterminable by the choice of the characteristic of the spring 62, the lance 18 finally bears on the internal support 24.

In FIG. 4, the lance is inserted as far as possible into the container. For this situation, FIG. 5 shows the diagrams of the bending moments and transverse forces in the lance 18.

Figure 5:
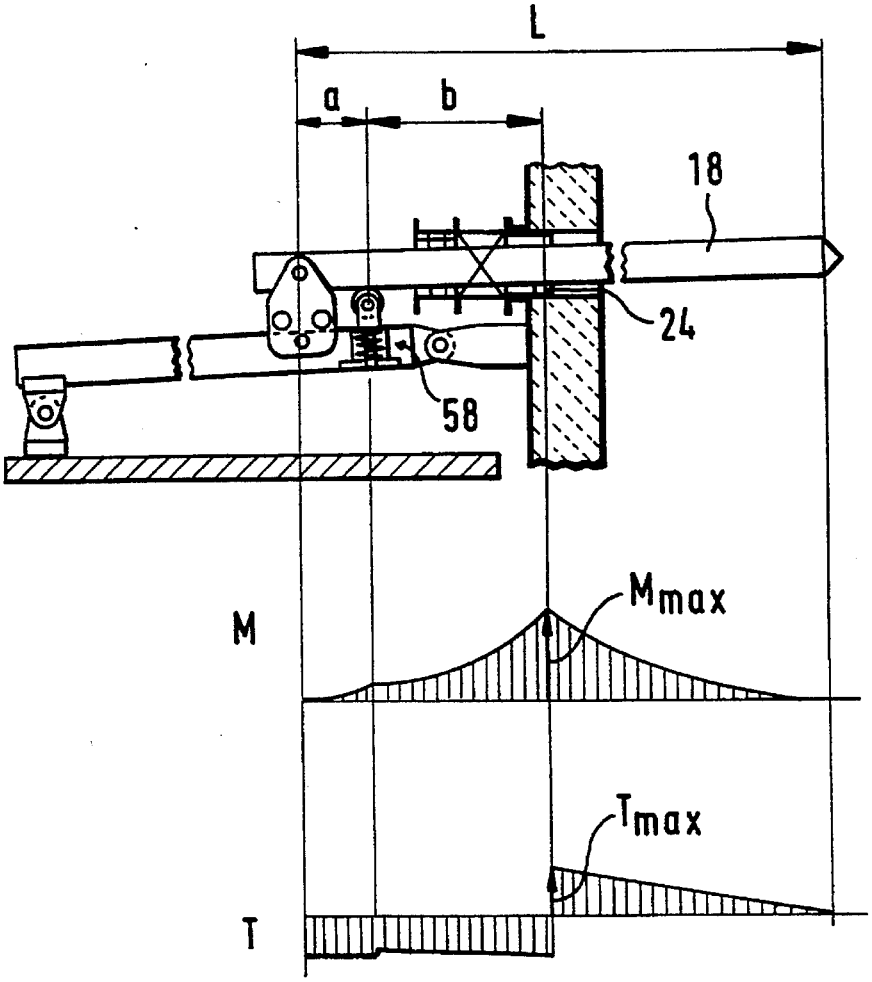
FIGS. 5 and 6 represent views of the device of FIG. 1 similar to FIG. 4, in which the diagrams of bending moment and transverse forces have been added (it will be noted that FIG. 6 represents a device which is not fitted with an elastic front support).
Figure 6:
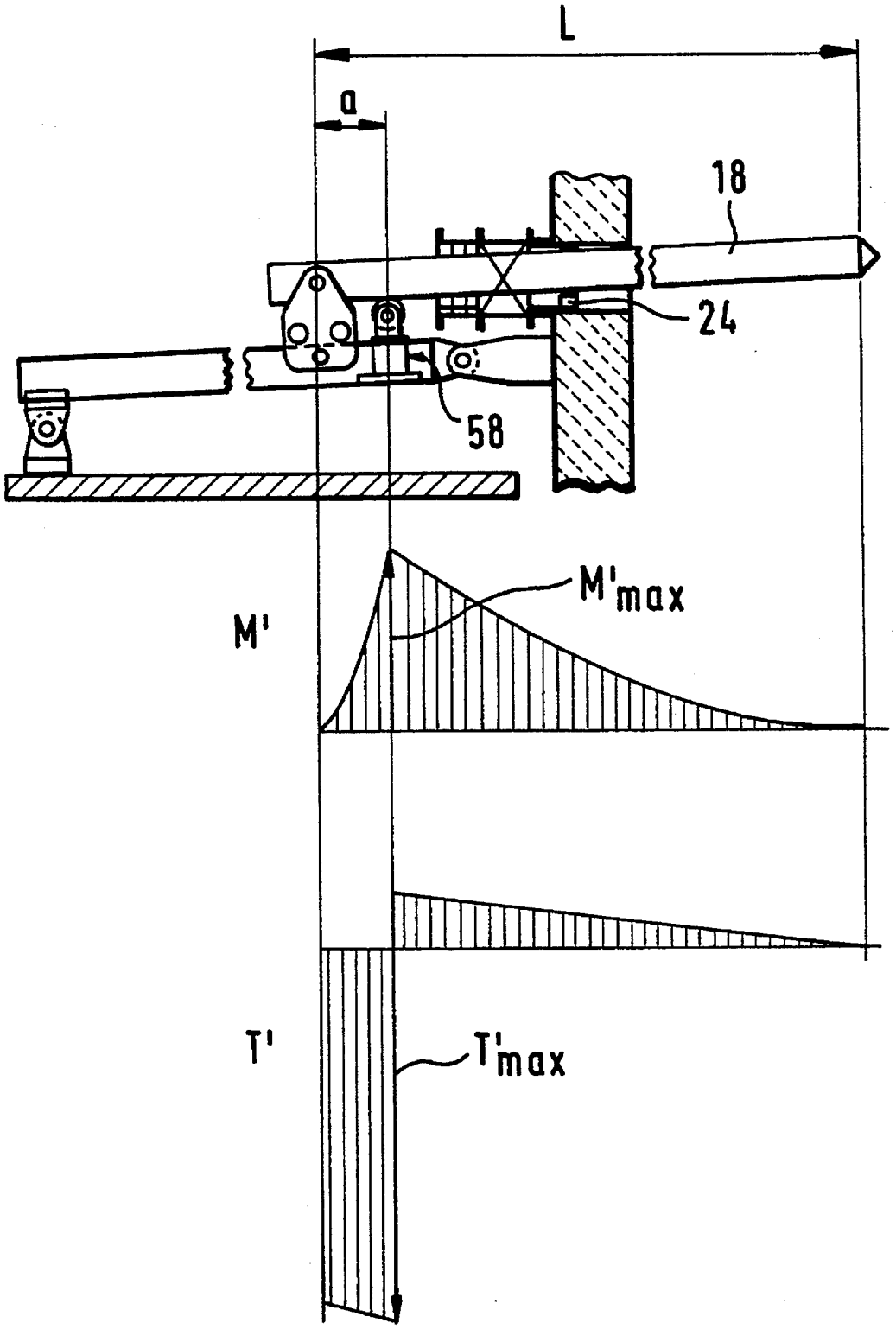

FIG. 6 represents, by way of comparison, a situation which differs from the situation in FIG. 5 only in that the front elastic support 58 has been replaced by a rigid support 58'. It is noted that, in FIG. 6, the bending moment and the transverse force have their maximum at the level of the front support 58'. This is not, in hindsight, surprising since the inclined lance is not bearing on the internal support 24. In FIG. 5, the bending moment and the transverse force have, in contrast, their maximum at the level of the internal support 24. This maximum is by far smaller than the respective maximum in FIG. 6.

It can be shown that the maximum bending moment M'max in FIG. 6 can be reduced by more than 50%, and the maximum transverse force T'max in FIG. 6 can be reduced by more than 70%, by replacing the fixed support 58' by an elastic support 58. These results demonstrate that the lance 18 is far less stressed in the device in FIG. 5 than in the device in FIG. 6.

An additional feature of the device for inserting the lance 18 into the pressurized container is described with the aid of the details of the sealing member 32 which are represented in FIGS. 1 to 4. This sealing member 32 comprises a casing 80 in which several rings 82, 84, 86 are arranged axially, the free cross-section of which rings corresponds substantially to the cross-section of the lance 18. Each of these rings 82, 84, 86 is mounted in a separate chamber 82', 84', 86' of the casing 80, in which it can be moved perpendicularly to the central axis 16'. This possibility of moving the rings 82, 84, 86 in their respective chamber 82', 84', 86' of the casing 80 allows the rings 82, 84, 86 to adapt to an oblique position of the lance 18 in the sealing member 32. In other words, the rings 82, 84, 86 can be freely centered on the body of the lance 18 which is oblique with respect to the central axis 16'.

It should be noted that the tings 82, 84, 86 either themselves constitute sealing members or supports for packing or radial sealing gaskets.

Figure 1A:
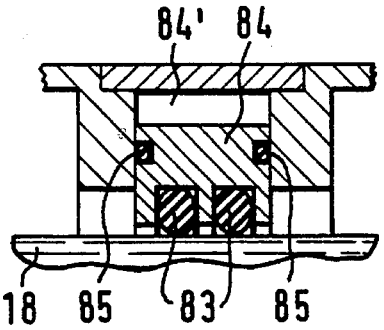
FIGS. 1A and 1B show details of a sealing member equipping the device of FIG. 1.

FIG. 1A represents a detail of a first embodiment of a ring 84 in its chamber 84'. It is seen that this ring is fitted with two sealing gaskets 83 with which it bears on the lance 18. Side sealing gaskets 85 ensure, if required, leaktightness between the ring 84 and the radial ribs defining the chamber 84'.

Figure 1B:
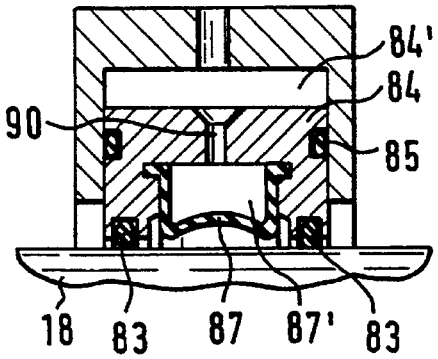

FIG. 1B represents an alternative embodiment of the ring 84 in its chamber 84'. It comprises an inflatable seal 87 installed in a cavity 87' of the ring 84. In the uninflated position, this inflatable seal 87 is set back in its cavity 87', which makes it possible to move the lance 18 without damaging or causing wear on the inflatable seal 87. In the inflated position, it can, however, compensate for much greater radial clearance than the two sealing gaskets 83 in FIG. 1A. As in FIG. 1A, the ring 84 advantageously bears with two sealing gaskets 83 which flank the cavity 87', on the lance 18. The inflatable seal 87 is advantageously pressurized by pressurizing the chamber 84'. Openings 90 in the ring 84 connect the chamber 84' with the cavity 87'. It should further be noted that the inflatable seal 87 may be inflated with a liquid or a gas under pressure.

While preferred embodiments have been shown and described, various modifications and substitutions may be made thereto, without departing from the spirit and scope of the invention. Accordingly, it is to be understood that the present invention has been described by way of illustrations and not limitations.

What is claimed is:

1. A device for inserting, from a support structure, a lance axially through a side opening in a pressurized container, comprising:

a support bench for the lance bearing with its rear end on the support structure and extending towards the side opening;

a support carriage for the lance, which can slide along the support bench and in which the rear end of the lance is articulated;

a sealing member and a closure member which are mounted on the pressurized container at the level of the side opening, said sealing member being adapted for interaction with the lance in order to ensure leaktightness around the lance when it is inserted therein, and said closure member being adapted to close the side opening when the lance is withdrawn;

a front support for the lance which is arranged in proximity to said sealing member;

an inner support for the lance which is arranged on the inner side of the pressurized container; and wherein said front support for the lance is an elastic support which is gradually pressed down under the weight of the lance, as the latter is inserted into said pressurized container, and which is mounted so as to follow the level variations of the side opening.

2. The device of claim 1, wherein the front end of the support bench is supported using an articulated support which is itself supported by the pressurized container in proximity to the side opening; and said front support is supported on the support bench in proximity to an articulated support of said support bench.

3. The device of claim 1, wherein the front support is directly supported by the pressurized container.

4. The device of claim 1, wherein said from support is supported by said sealing member.

5. The device according to any one of claim 1, wherein said front support comprises at least one spring.

6. The device of claim 5, wherein said spring is prestressed.

7. The device of claim 1, wherein:

said sealing member comprises one casing and a plurality of rings provided with through openings for the lance;

the casing is axially divided into separate chambers for the rings; and the rings are mounted in said chambers so that said rings are movable perpendicularly with respect to the central axis of said sealing member.

8. The device of claim 7, wherein said rings are fitted with packings or sealing gaskets with which they bear on the lance.

9. The device of claim 8, wherein at least one of said rings is fitted with an inflatable seal which is connected to a pressurization circuit and mounted in a cavity of its ring so as to be situated, when uninflated, entirely set back in this cavity.

* * * * *